US012000247B2

(12) United States Patent
Al-Anazi et al.

(10) Patent No.: US 12,000,247 B2
(45) Date of Patent: Jun. 4, 2024

(54) EXPANDABLE TUBULARS TO ISOLATE PRODUCTION CASING

(71) Applicant: Saudi Arabian Oil Company, Dhahran (SA)

(72) Inventors: Ammal F. Al-Anazi, Dammam (SA); Suhail A. Samman, Riyadh (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/730,975

(22) Filed: Apr. 27, 2022

(65) Prior Publication Data

US 2023/0349269 A1 Nov. 2, 2023

(51) Int. Cl.
*E21B 43/10* (2006.01)
*E21B 33/10* (2006.01)
*E21B 43/12* (2006.01)

(52) U.S. Cl.
CPC ..... *E21B 43/103* (2013.01); *E21B 33/10* (2013.01); *E21B 43/123* (2013.01)

(58) Field of Classification Search
CPC ..... E21B 43/103; E21B 33/10
See application file for complete search history.

(56) References Cited

U.S. PATENT DOCUMENTS 7,178,601 B2 * 2/2007 Burge ..... E21B 43/103 166/242.6
8,011,446 B2 * 9/2011 Wylie ..... E21B 33/138 175/45
10,844,682 B2 * 11/2020 Krüger ..... E21B 29/005

OTHER PUBLICATIONS

Bargawi et al., "Expandable Tubular Successfully Scab off Severe Casing Leaks," SPE-97357-MS, Society of Petroleum Engineers (SPE), Paper presented at the SPE/IADC Middle East Drilling Technology Conference and Exhibition, Dubai, United Arab Emirates, Sep. 2005, 4 pages.
Bybee, "Expandable-Tubular Solutions," SPE-0500-0047-JPT, Society of Petroleum Engineers (SPE), J Pet Technol 52(05): 47-48, May 2000, 2 pages.
Caplis et al., "Solid Expandable Liner System With Custom Composite Frac Plugs Enable Recovery of Lost Reserves In the Piceance Basin, " SPE-159751-MS, Society of Petroleum Engineers (SPE), 2012, 5 pages.

(Continued)

*Primary Examiner* — Jonathan Malikasim
(74) *Attorney, Agent, or Firm* — Fish & Richardson P.C.

(57) ABSTRACT

A production well has nested casings including a first production casing and a first production tubing installed within the first production casing, which extends from a surface to a depth within the wellbore. Before implementing a gas-lift operation in the production well, the first production tubing is removed. A second production casing is lowered within the first production casing. The second production casing has a smaller outer diameter than an inner diameter of the first production casing. From the surface of the wellbore to the depth within the wellbore to which the second production casing extends, the inner diameter of the second production casing is expanded until an outer wall of the second production casing forms a gas-tight seal with an inner wall of the first production casing.

5 Claims, 4 Drawing Sheets

(56) References Cited

OTHER PUBLICATIONS

Godfrey et al., "The Same Drift Monodiameter Completion System in Solving Drilling and Well Infrastructure Challenges," SPE-205961-MS, Society of Petroleum Engineers (SPE), Paper presented at the SPE Annual Technical Conference and Exhibition, Dubai, UAE, Sep. 2021, 12 pages.

Storaune et al., "Versatile Expandables Technology for Casing Repair," SPE-92330-MS, Society of Petroleum Engineers (SPE), Feb. 2005, 8 pages.

Szary et al., "Gas Tight Production Casing Remediation via Expandable Steel Patches," SPE-188870-MS, Society of Petroleum Engineers (SPE), Paper presented at the Abu Dhabi International Petroleum Exhibition & Conference, Abu Dhabi, UAE, Nov. 2017, 11 pages.

* cited by examiner

EXPANDABLE TUBULARS TO ISOLATE PRODUCTION CASING

TECHNICAL FIELD

This disclosure relates to wellbore operations, specifically to operations to mechanically isolate production casings installed in wellbores.

BACKGROUND

Hydrocarbons (e.g., oil, natural gas, or combinations of them) entrapped in subsurface reservoirs can be produced through wells formed from a surface of the Earth to the subsurface reservoirs. The wellbore is formed by drilling a wellbore from the surface to the subsurface reservoirs through a subterranean zone (e.g., a formation, a portion of a formation or multiple formations), and installing completions to form a production well. In primary production techniques, the pressure of the subterranean zone on the hydrocarbons drives the hydrocarbons through the production well to the surface. Over time, the pressure decreases, and secondary production techniques are needed to produce the hydrocarbons through the production well. One example of secondary production techniques includes gas lift in which a gas, e.g., carbon dioxide ($CO_2$), is injected at high pressure into the production well. The gas pressure reduces the hydrostatic pressure within the well, thereby reducing bottomhole pressure. The reduction in bottomhole pressure allows the hydrocarbons in the reservoir to enter the production well at a higher flow rate. An efficiency of the gas lift operation depends on preventing leakage of the injected gas into annulus formed between different strings or tubulars installed in the wellbore.

SUMMARY

This specification describes technologies relating to expandable tubulars to isolate production casing.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1B:
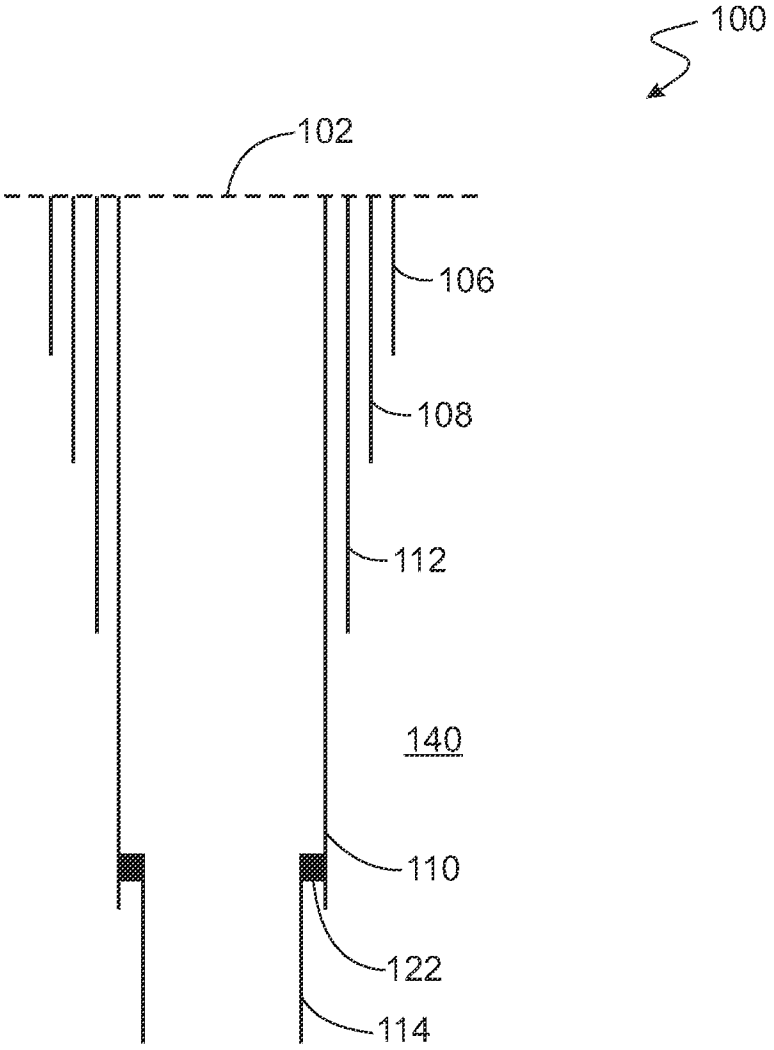
FIGS. 1A-1E are schematic diagrams showing steps to seal an expandable tubular against a production casing in a production well.
Figure 1A:
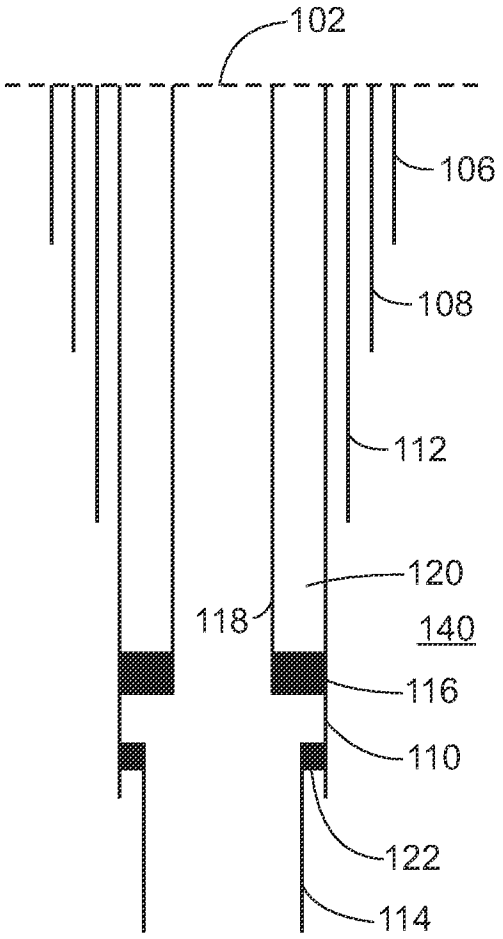

FIGS. 1A-1E are schematic diagrams showing steps to seal an expandable tubular against a production casing in a production well 100. FIG. 1A shows the production well 100 that has been formed from a surface 102 through a subterranean zone 104 to a subsurface reservoir (not shown) containing hydrocarbons. The production well 100 is formed by drilling a wellbore from the surface 102 through the subterranean zone 104. The production well 100 includes a conductor casing 106, which is a tubular or string that is usually put into the wellbore first, for example, while drilling the wellbore. The conductor casing 106 extends from the surface 102 towards the subsurface reservoir and prevents the subterranean zone 104 from caving into the wellbore during drilling. A surface casing 108 is nested within the conductor casing 106. The surface casing 108, which also extends from the surface 102 towards the subsurface reservoir, is another large-diameter string or tubular. In onshore production wells, the surface casings are installed at shallow depths to protect water aquifers. A production casing 110 is nested within the surface casing 108. The production casing 110 also extends from the surface 102 through the subterranean zone 104 and towards the subsurface reservoir. In some implementations, an intermediate casing 112 can be nested between the surface casing 108 and the production casing 110. Depending on the depth of the wellbore, one or more intermediate casings can be disposed to provide additional structural support to the production well 100. Of all the casings, the production casing 110 is the deepest.

In some implementations, a liner 114 extends from near a downhole end of the production casing 110 toward the subsurface reservoir. A downhole end of the liner 114 (i.e., the end farthest from the surface 102) resides in the subsurface reservoir. Perforations (not shown) are formed on the wall of the liner 114 near the downhole end to allow the hydrocarbons from the subsurface reservoir to flow into the liner 114. An outer surface of an uphole end of the liner 114 (i.e., the end that is nearer to the surface 102 than the downhole end) is sealed to an inner surface of the production casing 110, e.g., using packers 116.

In some implementations, a production tubing 118 is lowered within the production casing 110. Various well completions used to produce the hydrocarbons through the production well 100 are installed within the production tubing 118. An outer surface of the production tubing 118 and an inner surface of the production casing 110 define an annulus 120. A region of the annulus 120 near a downhole end of the production tubing 118 (i.e., the end opposite the end of the production tubing 118 at the surface 102) can be sealed, e.g., using packers 122. In this construction and arrangement, hydrocarbons enter the liner 114 through the perforations formed near the downhole end of the liner 114, flow in an uphole direction toward the surface 102 through the liner 114, and are received in the production tubing 118 to continue flowing in the uphole direction.

Upon installation, the packers 116 form tight seals that prevent the hydrocarbons from escaping into the annulus 120. Packer 122 acts as a liner hanger that supports the weight of the liner and attach it to the production casing. Additionally, packer 122 creates a seal that forces reservoir fluids to only be produced through the perforations (not shown). All casings are made of joints that are typically joined together at surface before running them downhole. The joints ends are threads that are either a male connection or a female connection. The thread connection, while capable of preventing liquid flow into the annuli, are not always gas tight. These connections are typically liquid-tight. However, in gas-lift applications premium gas-tight threads are recommended to provide a gas-seal that prevents gas from entering the casing-casing annuli (i.e., annuli between 110 and 112, 112 and 208, and 108 and 106) when gas is injected down the tubing-casing annulus 120. In addition, the seals deteriorate over time, in part, due to the well conditions (high temperature, high pressure, exposure to hydrocarbons that can be corrosive). If a gas-lift operation were performed, i.e., if high-pressure gas was injected through the tubing-casing annulus 120 in such a situation, well integrity can be breached. As described below with reference to FIGS. 1D-1E, the production well 100 can be prepared for a safer gas-lift operation by lowering a tubular with gas-tight thread connections that overlays the old production casing 110 from the surface 102 to the downhole end of the production casing 110, thus creating a gas-tight system that prevents gas leakage in the casing-casing annuli and also scab-off the old and deteriorated production casing with a new and fresh layer of tubulars.

FIG. 1B is a schematic diagram showing the production well 100 from which the production tubing 118 has been removed. The production tubing 118 is removed from within the production casing 110 as a first step to prepare the production well 100 for a gas-lift operation. Any completion that was installed within the production tubing 118 as well as any packers 116 or other completion equipment used to install the production tubing 118 are also removed from within the production casing 110.

Figure 1D:
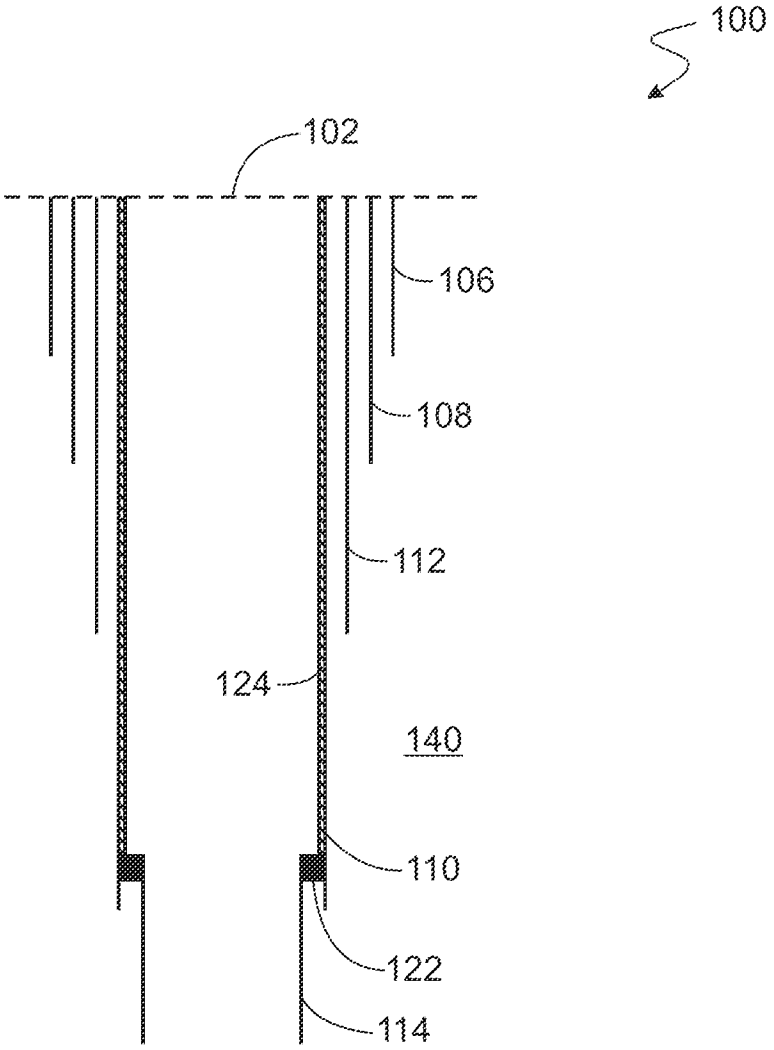
Figure 1C:
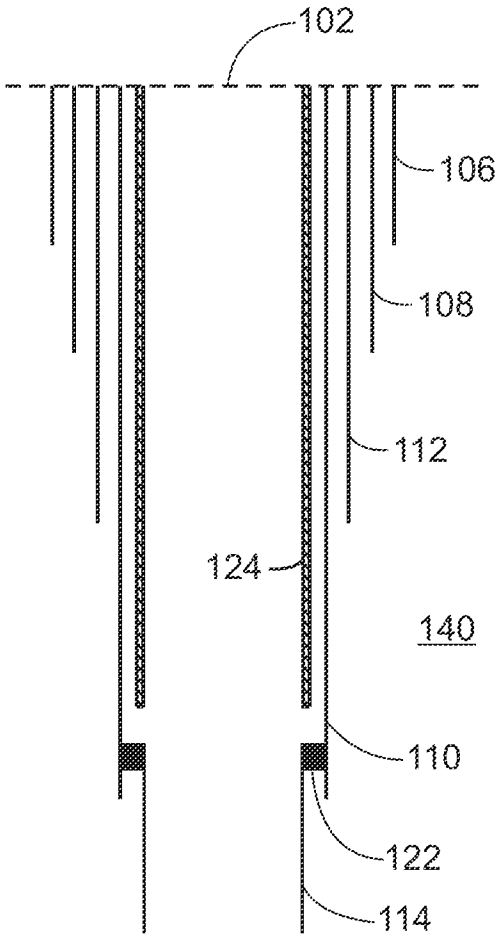

FIG. 1C is a schematic diagram showing an expandable tubular 124 lowered within the production casing 110. When lowered within the production casing 110, an outer diameter of the tubular 124 is less than an inner diameter of the production casing 110. A length of the tubular 124 is at least equal to that of the production casing 110. Thus, when the tubular 124 is lowered into the production casing 110, both the tubular 124 and the production casing 110 extend to at least the same depth within the production well 100. Expandable tubulars can be made of steel that is deformed hydraulically or mechanically in order to expand them to a certain precalculated size. After lowering the tubular 124 into the production casing 110 to the same depth as the production casing 110, the tubular 124 is expanded until an outer wall of the tubular 124 is flush against an inner wall of the production casing 110 for an entire length of both the tubular 124 and the production casing 110. Compared to lowering a conventional cemented casing, which requires a smaller size casing to be lowered then cemented by circulating the cement between the new casing and the production casing 110, the expandable casing does not require cement and results in a much larger wellbore's inside diameter that allows lowering a larger or similar size tubing 118 as the original one. The expandable tubular can be expanded either mechanically or hydraulically. In case of a mechanical expansion, a tool with the required size is lowered after the expandable tubular is run into place. The tool is then forced inside the unexpanded casing forcing it to deform and take the size of the tool. In case of a hydraulic expansion, an elastic material inside the tubular can be expanded by applying high pressure until it is deformed to the required size.

Figure 1E:
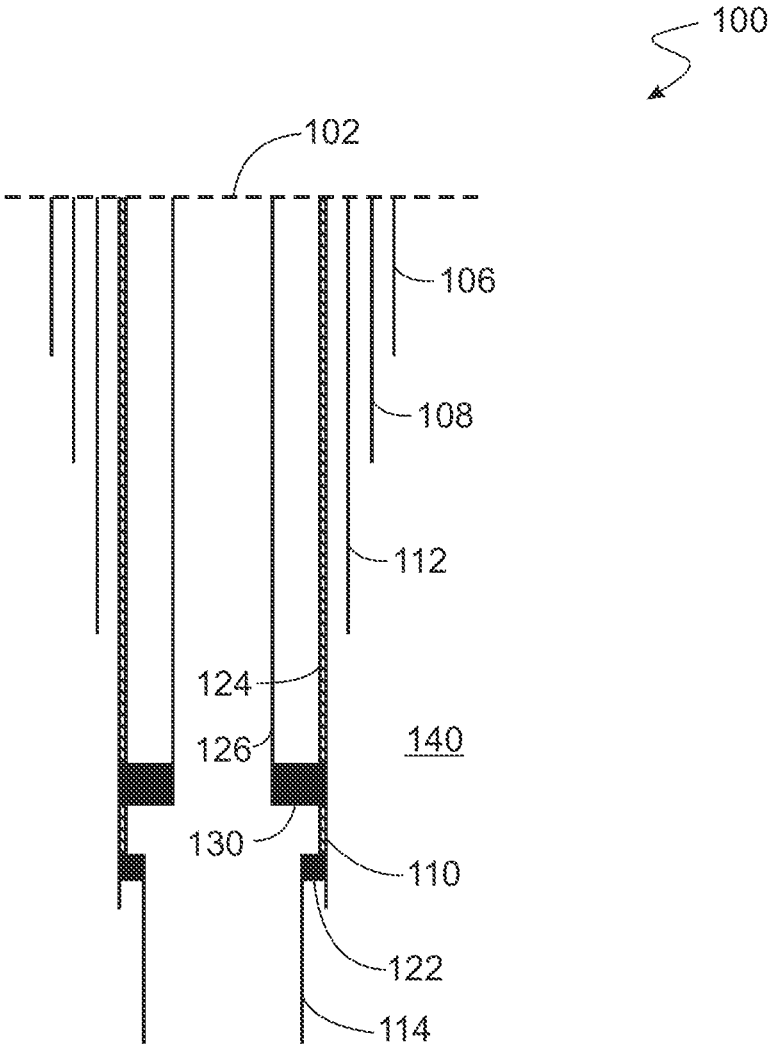

FIG. 1D is a schematic diagram showing the expandable tubular 124 after expansion. Following the expansion of the tubular 124, the outer surface of the tubular 124 forms a metal-to-metal, gas-tight seal against the inner surface of the production casing 110 for an entire length of both the tubular 124 and the production casing 110. In addition, almost an entirety of the volume within the production casing 110 remains available to lower a new production tubing 126 having substantially the same diameter as the production tubing 118. FIG. 1E is a schematic diagram showing the new production tubing 126 lowered into the production casing 110 within which the tubular 124 has been expanded. The new production tubing 126 is lowered and installed in the same manner in which the production tubing 118 is lowered and installed with a new packer installed similar to the packers 116 to isolate the new tubing-expandable-annulus from the rest of the wellbore. The annulus between an inner wall of the production casing 110 and an outer wall of the expanded tubular 124 is flushed with metal to metal seal and on the upper and lower ends is isolated with elastomers that are squeezed in between the two. New packers 130 can be used to seal an annulus formed between an outer wall of the new production tubing 126 and an inner wall of the expanded tubular 124 near a downhole end of the new production tubing 126. Well operations including, for example, gas-lift operations or continued production, can be resumed after installing the new production tubing 126 and the new packers 130.

By expanding the tubular 124 along an entire length of the production casing 110, all zones with any metal loss are scabbed off, and integrity of the production well 100 can be maintained. Doing so also seals any connections of the production casing 110 that are not gas-tight, and avoids direct exposure of the production casing 110 to high-pressure gas injected during gas-lift operations. The seals formed by the expanded tubular 124 prevents injected gas from entering the expandable-production casing-annulus (124-110-annulus), thus avoids gas entering the other casing-casing annuli, which could reach surface causing a sustained positive pressure that might lead to a leak at the surface 102. Also, expanding the tubular 124 allows running a new production tubing 126 that has substantially (or exactly) the same inner and outer diameters as the production tubing 118. Consequently, the volume and flow rate of produced hydrocarbons is the same or not significantly altered using the expandable tubular approach compared to using a conventional method of lowering a smaller size new cemented production casing similar to 110 that would result in a much smaller wellbore's inside diameter requiring a smaller production tubing to be lowered than the original one 118.

Figure 2:
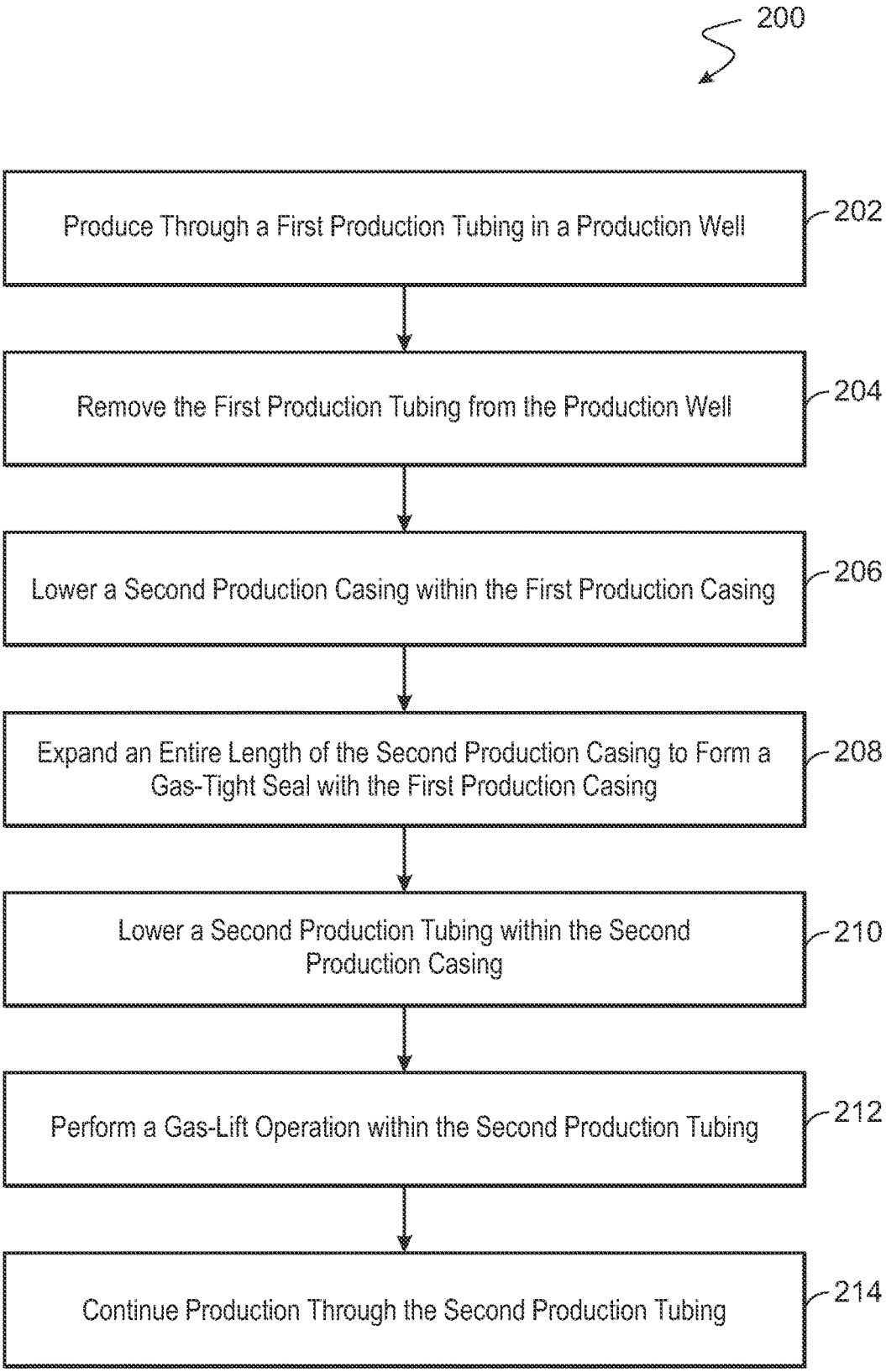
FIG. 2 is a flowchart of an example of a method to seal an expandable tubular against a production casing in a production well.

FIG. 2 is a flowchart of an example of a process 200 to convert a naturally flowing non-gas-tight well into a gas-lifted gas-tight well utilizing expandable tubular (e.g., the tubular 124). This results in achieving a gas-tight system that is suitable for gas-lift operations, maintain well integrity by scabbing the old production casing (e.g., the production casing 110) with a fresh layer of steel and avoid gas entry through old casing connections to the casing-casing annuli, and achieve a larger size wellbore compared to lowering a new conventional cemented casing. The steps of process 200 can be implemented by an operator (or operators) of the production well 100. At step 202, hydrocarbons can be produced through a first production tubing (e.g., production tubing 118) in a production well (e.g., production well 100). At step 204, the first production tubing 118 can be removed from the production well 100 in preparation to lower down and install the expandable tubular 124 against the production casing 110 to safely convert the well to a gas-tight system. At step 206, a second production casing (e.g., the expandable tubular 124) can be lowered within the first production casing (e.g., the production casing 110) along its full length. At step 208, an entire length of the second production casing can be expanded to form a gas-tight seal with the first production casing. For example, using the techniques described above, the expandable tubular 124 is expanded within the production casing 110 such that an outer wall of the expandable tubular 124 contacts and forms a metal-to-metal, gas-tight seal against an inner wall of the production casing 110 for an entire length of the expandable tubular 124 and the production casing 110. At 210, a second production tubing (e.g., the new production tubing 126) that is fitted with gas-lift valves is lowered within the second production casing (e.g., the expanded tubular 124). At 212, a gas-lift operation is performed within the second production tubing. For example, high-pressure gas is injected from the surface 102 into the annulus between the new production tubing 126 and the new second production casing 124, also known as the tubing-casing-annulus. At 214, hydrocarbon production is continued through the second production tubing (e.g., the new production tubing 126).

By implementing the techniques described in this disclosure, existing old production casing can be remedied and full production well integrity can be restored by installing a new layer of expandable casing on top of the old production casing. Gas-tight requirements can be met for gas-lift applications by sealing old connections with elastomer seals on the outer surface of the expandable and also have the expandable tubular connections gas-tight. That is, in some implementations, an elastomer layer can be added to an outer surface of the expandable tubular 124 prior to expansion. By doing so, the elastomer layer can form a gas-tight seal with an inner wall of the production casing 110. Furthermore, using expandable tubular 124 results in a larger wellbore internal diameter when compared to lowering a new smaller size conventional cemented production casing that is similar in installation as the production casing 110. This allows lowering a same size second production tubing 126 to the original one 118, which allows to maintain the same production volumes from the well.

Thus, particular implementations of the subject matter have been described. Other implementations are within the scope of the following claims.

The invention claimed is:

1. A method comprising:

in a production well comprising a first production casing nested within a surface casing nested within a conductor casing, a liner downhole of the first production casing, the liner having an outer diameter smaller than an outer diameter of the first production casing:

lowering a second production casing within the first production casing, the second production casing extending from a surface of the production well to a depth within the production well to which the first production casing extends and uphole of the liner, the second production casing having a smaller outer diameter than an inner diameter of the first production casing and larger than the outer diameter of the liner;

from the surface of the production well to the depth within the production well to which the second production casing extends, forming a gas-tight seal between an outer wall of the second production casing and an inner wall of the first production casing by expanding the inner diameter of the second production casing from the surface to the depth to which the second production casing extends, wherein an inner diameter of the expanded second production casing is larger than the outer diameter of the liner;

installing a production tubing within the second production casing from a surface of the production well to uphole of the liner, the production tubing extending a same length as the second production casing;

flowing hydrocarbons in an uphole direction through the liner and into the expanded second production casing.

2. The method of claim 1, wherein the inner diameter of the second production casing is expanded for an entirety of a length of the second production casing from the surface of the production well to the depth to which the second production casing extends.

3. The method of claim 1, further comprising implementing a gas-lift operation within the second production tubing.

4. The method of claim 3, wherein implementing the gas-lift operation comprises flowing gas through the second production tubing from the surface of the production well.

5. The method of claim 4, wherein expanding the inner diameter of the second production casing comprises expanding the diameter mechanically or hydraulically.

* * * * *